US005351738A

United States Patent [19]

Petersen et al.

[11] Patent Number: 5,351,738

[45] Date of Patent: Oct. 4, 1994

[54] ROLLER SCREEN FOR SHIELDING AN OPENING IN A WALL OR IN AN INCLINED ROOF SURFACE

[75] Inventors: Stefan D. Petersen, Skjern; Ove Kold, Borris; Niels K. Jensen, Skjern, all of Denmark

[73] Assignee: V. Kann Rasmussen Industri A/S, Søborg, Denmark

[21] Appl. No.: 12,385

[22] Filed: Feb. 2, 1993

[30] Foreign Application Priority Data

Feb. 17, 1992 [DK] Denmark ..... 198/92

[51] Int. Cl.[5] ..... A47H 1/00

[52] U.S. Cl. ..... 160/120; 160/290.1

[58] Field of Search ..... 160/290.1, 276, 270, 160/271, 273.1, 272, 275, 281, 288, 23.1, 120, 241, 25

[56] References Cited

U.S. PATENT DOCUMENTS

| | | | |
|---|---|---|---|
| 1,766,730 | 6/1930 | Traut | 160/276 X |
| 3,911,992 | 10/1975 | Webb | 160/290.1 |
| 4,702,297 | 10/1987 | Van Klompenburg | 160/290.1 X |
| 4,757,852 | 7/1988 | Jentof et al. | 160/290.1 X |
| 5,090,468 | 2/1992 | Tedeschi | 160/290.1 |

*Primary Examiner*—David M. Purol
*Attorney, Agent, or Firm*—Lane, Aitken & McCann

[57] ABSTRACT

For shielding a window area (2) in a wall or an inclined roof surface (3) a roller screen, e.g. an insect net (1), is provided which comprises a spring-biassed roller bar (9) at the upper edge of the opening (2) and a bottom bar (13) at the lower edge of a flexible screen web (1). The bottom bar (13) has guide members (17) slidable in guide rails (11, 12) having at the bottom a locking device for arresting the bottom bar (13). At either end of the bottom bar, the guide members include a guide member (17) and a subjacent roll (18) pivotally journalled in the bottom bar (13) so that, from a first position in which it is in axial alignment with the guide member, the roll may be swung to a locking position outside the path of movement of the guide member (17). The rolls (18) are functionally connected and biassed so that the first position and the locking position are stable switch-over positions. At the end of each guide rail (11, 12), a stop member (23) is mounted in which a lateral cutout (25) is formed at the bottom of a track (24) in axial alignment with the guide rail (11, 12) for receiving and retaining the roll (18) in the locking position.

12 Claims, 2 Drawing Sheets

ROLLER SCREEN FOR SHIELDING AN OPENING IN A WALL OR IN AN INCLINED ROOF SURFACE

BACKGROUND OF THE INVENTION

The invention relates to a roller screen, in particular in the form of an insect net or the like for shielding an opening, in particular a window area in a wall or an inclined roof surface, comprising a spring-biassed roller bar to be mounted at an upper edge of the opening and a bottom bar at a bottom edge of a flexible screen web designed to be rolled up and unrolled from the roller bar, said bottom bar having at the ends guide members slidable in channels in guide rails arranged along the lateral edges of the opening, and an arrestable locking device for engagement with a retainer device at the bottom of each guide rail.

In a roller screen known krom DE-C-1 864 087 the guide rails are mounted on the lateral walls facing the light area of the opening and the retaining device at the bottom of each guide rail includes a spring tongue mounted in the guide rail to be engageable with a slit or an aperture in a slide plate secured at the lateral edges of the screen material itself and connected with the end of the bottom bar.

This design suffers from the inconvenience that the release of the locking engagement requires simultaneous release of the engagement between said tongues and slide plates at both ends of the bottom bar. By a skew manipulation it might therefore happen that the locking engagement is released only at one side with the risk that the screen web material crinkles and possibly becomes damaged when squeezed in the guide rails.

From U.S. Pat. No. 1,766,730 a construction of the above mentioned type is known in which the arrestable locking device at the ends of the bottom bar inludes a pin or bolt displaceable in the longitudinal direction of the roller and being further displaceable by means of an operating handle to engage an opening in the guide rail. This design requires that the bottom bar occupies a correct position in relation to said openings in both guide rails prior to operating the locking device and, likewise, the release of the locking device requires separate operation.

SUMMARY OF THE INVENTION

It is the object of the invention to provide a new design of a roller screen of the above mentioned type, in which the above referenced drawbacks are remedied. According to the present invention, a roller screen of the kind defined is provided which comprises a spring-biassed roller bar for mounting at an upper edge of the opening, a flexible screen web connected at a top edge with the roller bar for permitting rolling-up and unrolling of the web from the roller bar, and a bottom bar connected with a bottom edge of the flexible screen web, guide members provided at the ends of the bottom bar, guide rails arranged along lateral edges of the opening and including channels accommodating the guide members for slidable movement, a retainer device arranged on each of the lateral walls at the bottom of each guide rail, an arrestable locking device provided at either end of the bottom bar and including a roll positioned beneath the guide member and engaging the channel in the guide rail, the roll being pivotally journalled in the bottom bar so that, from a first position in which it is aligned with the guide member while accommodated in the channel, the roll may be swung or pivoted to a second, locking position and located outside the path of movement of the guide member, the rolls at either end of the bottom bar being connected together and biassed so as to cause the first and second positions to be stable switch-over positions, the retainer device being formed as a stop member including a track extending in axial alignment with the channel of the guide rail and a lateral recess formed at a bottom of the track for receiving and retaining the roll in its second position.

By arranging the arrestable locking member in the arresting mechanisms at either end of the bottom bar in the form of said rolls and connecting them functionally together a simultaneous operation of both rolls for releasing the locking engagement is ensured, even though the operation involves skew loading of the bottom bar. The release merely requires operation of the bottom bar itself, thereby eliminating the need for a separate operating handle.

The construction of the arresting mechanism with said stop members provided by the invention is particularly suitable in connection with a roller screen for shielding adjacent openings, in particular a skylight, in an inclined roof surface and a subjacent dwarf wall.

According to the present invention, an embodiment of a roller screen of the above mentioned type particularly appropriate for that purpose may comprise two screen webs with individual roller bars positioned at the upper edge of the opening in the roof surface and at the lower edge of the opening in the dwarf wall, respectively, and with individual bottom bars together with guide rails pertaining to each of said webs and mounted at the lateral edges of both openings so that the guide rails pertaining to the opening in the roof surface and the opening in the dwarf wall, respectively, extend in common planes and form an angle with each other corresponding to the inclination of the roof surface, stop members being mounted at the adjacent ends of the guide rails for the openings in the roof surface and the dwarf wall, respectively, each of said stop members being provided with said track and cutout and being interconnected by means of a hinge joint allowing the angle between said stop members to be adjusted.

BRIEF DESCRIPTION OF THE DRAWINGS

The invention will now be explained in detail with reference to the schematical drawings, in which.

DESCRIPTION OF THE PREFERRED EMBODIMENT

Figure 1:
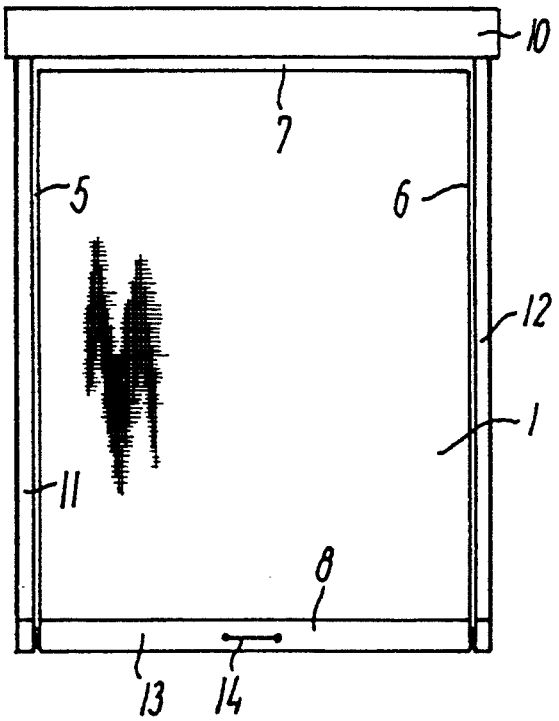
FIGS. 1 and 2 illustrate a roller screen according to the invention used in connection with a window opening in an inclined wall, viewed from the inside of the room and in a sectional side view, respectively.
Figure 2:
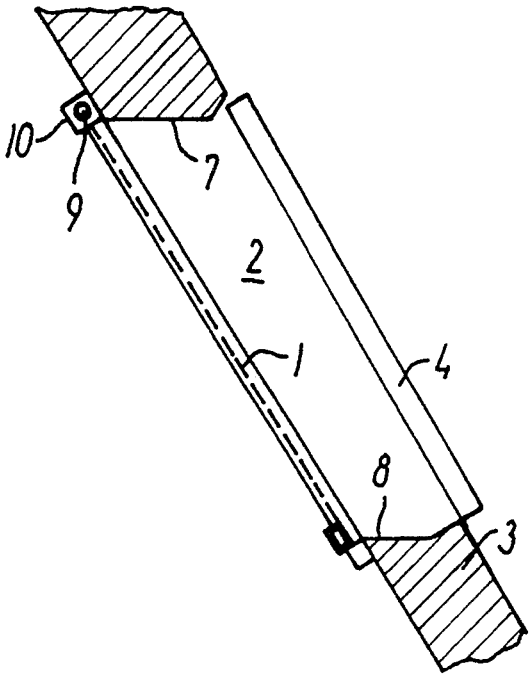

In the embodiment in FIG. 1 a roller screen in the form of an insect net 1 is mounted for shielding an opening 2 in an inclined roof surface 3 in which a skylight 4 is mounted. The light area of the opening 2 is limited by side walls 5 and 6, an upper wall 7 and a lower wall 8 and the roller screen 1 is mounted on the internal side of the inclined wall 3 with a spring-biassed roller bar 9 designed in a conventional manner and positioned in a cassette 10 at the upper edge of the opening 2.

A guide rail 11, 12, respectively, is mounted at the lateral edges of each of the walls 5 and 6, said guide rails including channels for receiving guide members mounted at either end of the bottom bar 13 of the roller screen which in the illustrated manually operated design has an operating handle 14.

Figure 5:
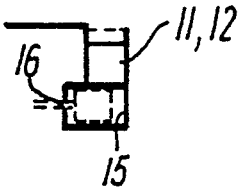

As illustrated in FIG. 5, the channel 15 in each of the guide rails 11 and 12 has a substantially rectangular cross-section with a constricted slit-like opening 16 through which the guide member of the bottom bar may pass.

Figure 3:
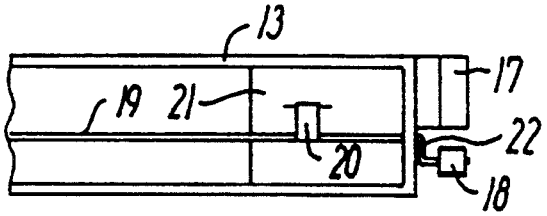
FIGS. 3 and 4 illustrate one end of the bottom bar of the roller screen with associated guide and arresting members, FIG. 5 a profile section of an embodiment of a guide rail, FIG. 6 an embodiment of a stop member to be mounted at the end of a guide rail, FIG. 7 an embodiment of a roller screen for shielding adjacent openings in an inclined roof surface and a subjacent dwarf wall.
Figure 4:
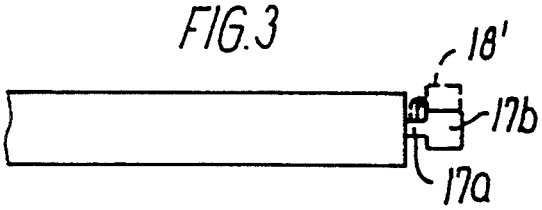

As illustrated in FIGS. 3 and 4, the guide member at either end of the bottom bar 13 includes a slide block 17 made from a suitable plastic material, e.g. nylon. As it most clearly appears from FIG. 4, the slide block 17 of the bottom bar 13 has adjacent the end wall a comparatively narrow connection part 17*a* corresponding to the width of the slit-shaped opening 16 in the guide rail and inside the guide rail a thickened part 17*b* with dimensions corresponding to the cross-sectional area of the channel 15.

For use in arresting the bottom bar 13 in the bottom position shown in FIG. 1 there is at either end of the bottom bar further mounted a roll 18 which pivotable between a first position in which it is axially aligned with the thickened part 17*b* of the slide block 17 when viewed in the direction of movement of the bottom bar, said roll 18 having a diameter corresponding to the width of the slide block so that the roll 18 in this position allows unimpeded movement of the slide block 17 in the guide rail and thereby rolling down and up of the roller screen 1, and a second position as shown in dotted lines at 18' in FIG. 4, in which it is outside the path of movement of the thickened part 17*b* of the slide block 17.

The rolls 18 at the two ends of the bottom bar 13 are functionally connected in such a manner that said two positions are bistable switch-over positions which in the illustrated embodiment is obtained in that the rolls 18 are mounted on a common shaft 19 biassed by a leaf spring 20 mounted within an end block 21 of the bottom bar 13, and immediately outside each of the end walls of the bottom bar 13 the shaft 19 has a cranked portion 22 for parallel displacement of the shaft ends inserted into the rolls 18 in relation to the part of the shaft extending through the bottom bar 13.

Figure 6:
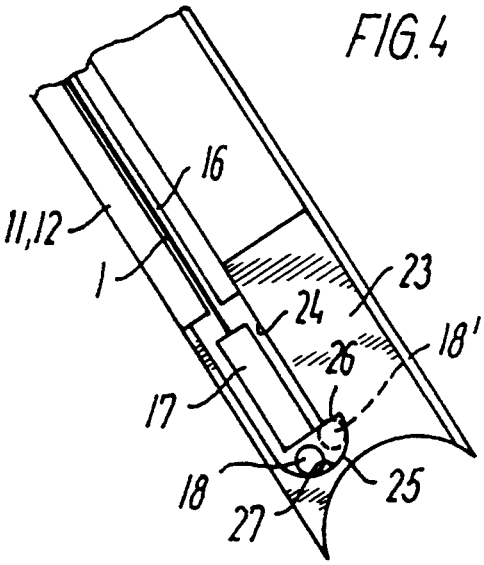

For retaining the roll 18 in the bottom position of the bottom bar there is, as illustrated in FIG. 6, at the lower end of each of the guide rails 11 and 12 mounted a stop member 23 including a track 24 oriented in axial alignment of the channel 15 of the guide rail and at the bottom of which a transverse recess 25 is provided to receive the roll 18 in its outwards pivoted position. The recess 25 merges into a shoulder portion 26 serving as abutment for the roll 18 and being substantially perpendicular to the sides of the track 24.

For restricted guidance of the movement of the roll 18 from the first to the second position the recess 25 is connected with the opposite wall of the track 24 through a curved wall portion 27 forcing the roll 18 to occupy the outwards pivoted position 18'.

When the locking engagement between the roll 18 and the shoulder 26 at the cutout 25 is to be released for rolling up the roller screen 1 the bottom bar 13 is drawn upwards, thereby forcing the roll 18 back to the first position in alignment of the slide block 17.

Figure 7:
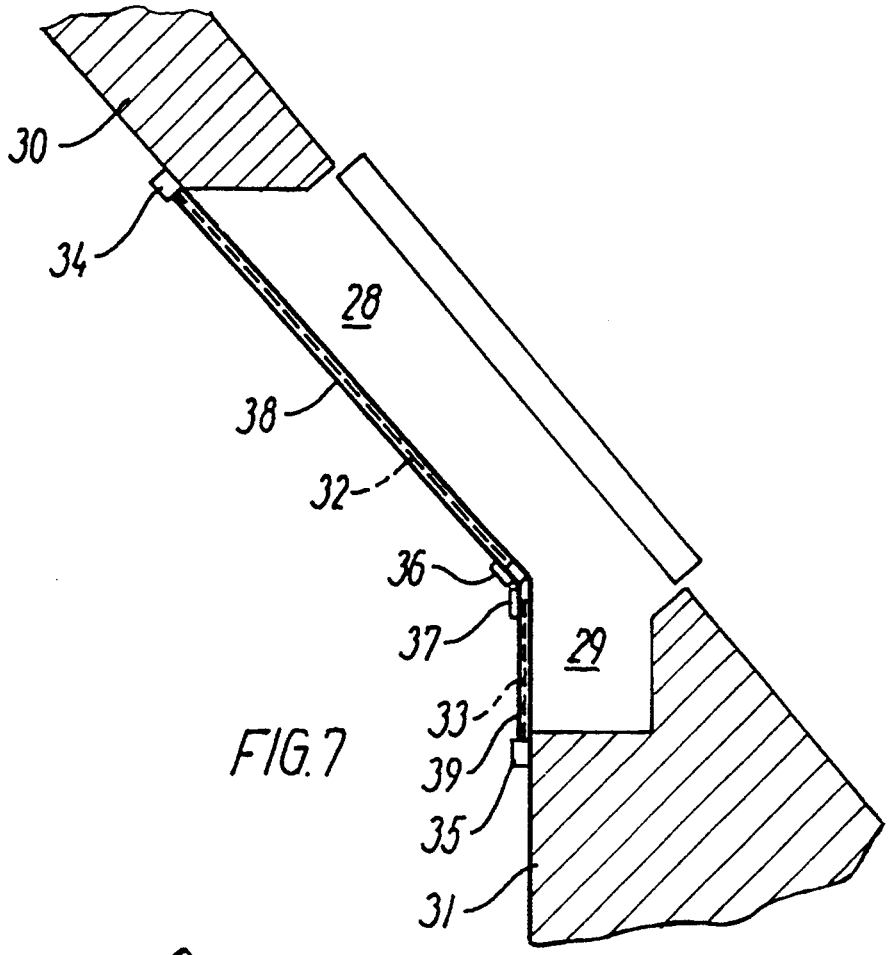
Figure 8:
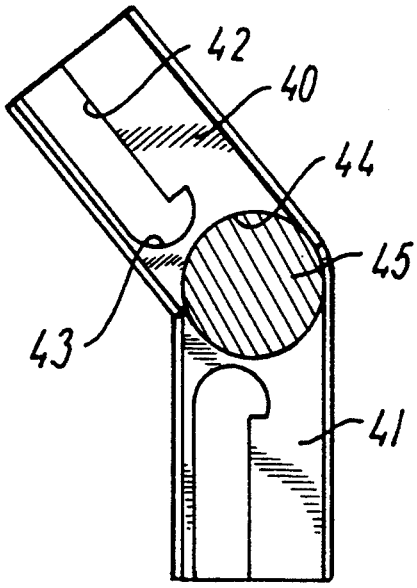
FIG. 8 is an enlarged, fragmentary vertical section of FIG. 7 illustrating the connection of stop members for the guide rails in the two openings.

FIGS. 7 and 8 illustrate an embodiment of a roller screen according to the invention, designed for shielding two adjacent openings 28 and 29 in an inclined roof surface 30 and a subjacent dwarf wall 31.

In this embodiment the roller screen includes two screen webs 32 and 33 each having a roller bar mounted in cassettes 34 and 35, at the upper edge of the opening 28 in the inclined roof surface 30 and at the lower edge of the opening 29 in the dwarf wall 31. Either of the roller screens 32 and 33 likewise have a bottom bar 36 and 37, respectively, and separate guide rails 38 and 39, respectively, for the screen webs 32 and 33 are likewise mounted at either side of the openings 28 and 29.

Each of the bottom bars 36 and 37 is provided with guide members in the form of slide blocks and has pivotal rolls as described in the foregoing, and stop member in the form of blocks 40 and 41 which, as illustrated in FIG. 8, mainly have the same form as described in the foregoing with tracks 42 and curved wall portions 43 mounted at the adjacent ends of the guide rails 38 and 39 at the bend between the openings 28 and 29.

With a view to obtain exact connection and in order to allow sealing abutment between the bottom bars 36 and 37 in the completely unrolled positions of the roller screens 32 and 33, cylinder faces 44 engaging a cylindrical pin 45 are provided at the adjacent ends of the blocks 40 and 41. By this connection the angle between the blocks 40 and 41 and thus between the guide rails 38 and 39 may be made to conform to the actual roof inclination.

The invention is not restricted to the above described examples shown in the drawings, since the roller screen may be any form of a shielding equipment of flexible material, e.g. a roller blind or a blackout curtain. In its basic design the invention may also be used with the same advantages in connection with window openings in vertical walls and it is not either limited to the illustrated mounting of the guide rails on the internal sides of the walls inside of the opening, even though this mounting entails advantages as regards the possibilities of opening the window and simultaneous use of the roller screen, e.g. in connection with insect nets.

We claim:

1. A roller screen for shielding an opening in a wall or an inclined roof surface (3; 30) comprising a spring-biassed roller bar (9) for mounting at an upper edge of the opening (2; 28), a flexible screen web connected at a top edge with said roller bar for permitting rolling-up and unrolling of the web from the roller bar (9), and a bottom bar (13; 36) connected with a bottom edge of the flexible screen web (1; 32, 33) guide members (17) provided at the ends of said bottom bar (13; 36, 37), in guide rails (11, 12) arranged along lateral edges of the opening (2) and including channels (15) accommodating said guide members for slidable movement, a retainer device arranged on each of said lateral walls at the bottom of each guide rail (11, 12), an arrestable locking device provided at either end of the bottom bar and including a roll (18) positioned beneath the guide member (17) and engaging the channel (15) in the guide rail (11, 12), said roll being pivotally journalled in the bottom bar (13) so that from a first position in which it is aligned with the guide member (17) while accommodated in said channel, said roll may be pivoted to a second, locking position and located outside the path of movement of the guide member (17), the rolls (18) at either end of the bottom bar (13) being connected together and biassed to cause said first and second positions to be stable switch-over positions, said retainer device being formed as a stop member (23) including a track (24) extending in axial alignment with the channel (15) of the guide rail (11, 12) and a lateral recess (25) formed at a bottom of said track for receiving and retaining said roll (18) in its second position.

2. A roller screen according to claim 1, wherein said rolls (18) at the ends of the bottom bar (13) are connected through a spring-biassed shaft (19) with cranked end portions (22).

3. A roller screen according to claim 1, wherein said bottom of the track (24) in said stop member (24) is provided with a curved wall (27) for restricted guidance of the roll (18) into said recess.

4. A roller screen according to claim 1, wherein the roller bar (9) and the guide rails (11, 12) are mounted on the internal side of said wall or roof surface (3).

5. A roller screen according to claim 1 for shielding adjacent openings (28, 29) in an inclined roof surface (30) and a subjacent dwarf wall (31), comprising two screen webs (32, 33) with individual roller bars positioned at the upper edge of the opening (28) in the roof surface (30) and at the lower edge of the opening (29) in the dwarf wall, respectively, said webs having individual bottom bars (36, 37), guide rails (38, 39) pertaining to each of said webs being mounted at the lateral edges of both openings so that the guide rails (38, 39) pertaining to the opening in the roof surface (30) and the opening (29) in the dwarf wall (31), respectively, extend in common planes and form an angle with each other corresponding to the inclination of the roof surface, stop members (40, 41) being mounted at the adjacent ends of the guide rails (38, 39) for the openings (28, 29) in the roof surface (30) and the dwarf wall (31), respectively, each of said stop members including said track (42) and said recess (43), said stop members being interconnected by a hinge joint (44, 45) allowing the angle between said stop members to be adjusted.

6. A roller screen according to claim 5, characterized in that said hinge joint includes a cylindrical pin (45) in sealing abutment on cylinder faces (44) formed at adjacent ends of the two stop members (40, 41).

7. A roller screen according to claim 2, wherein said bottom of the track in said stop member is provided with a curved wall for restricted guidance of the roll into said recess.

8. A roller screen according to claim 2, wherein the roller bar and the guide rails are mounted on the internal side of said wall or roof surface.

9. A roller screen according to claim 3, wherein the roller bar and the guide rails are mounted on the internal side of said wall or roof surface.

10. A roller screen according to claim 2 for shielding adjacent openings in an inclined roof surface and a subjacent dwarf wall, comprising two screen webs with individual roller bars positioned at the upper edge of the opening in the roof surface and at the lower edge of the opening in the dwarf wall, respectively, said webs having individual bottom bars, guide rails pertaining to each of said webs being mounted at the lateral edges of both openings so that the guide rails pertaining to the opening in the roof surface and the opening in the dwarf wall, respectively, extend in common planes and form an angle with each other corresponding to the inclination of the roof surface, stop members being mounted at the adjacent ends of the guide rails for the openings in the roof surface and the dwarf wall, respectively, each of said stop members having said track and said recess, said stop members being interconnected by a hinge joint allowing the angle between said stop members to be adjusted.

11. A roller screen according to claim 3 for shielding adjacent openings in an inclined roof surface and a subjacent dwarf wall, comprising two screen webs with individual roller bars positioned at the upper edge of the opening in the roof surface and at the lower edge of the opening in the dwarf wall, respectively, said webs having individual bottom bars, guide rails pertaining to each of said webs being mounted at the lateral edges of both openings so that the guide rails pertaining to the opening in the roof surface and the opening in the dwarf wall, respectively, extend in common planes and form an angle with each other corresponding to the inclination of the roof surface, stop members being mounted at the adjacent ends of the guide rails for the openings in the roof surface and the dwarf wall, respectively, each of said stop members including said track and said recess, said stop members being interconnected by a hinge joint allowing the angle between said stop members to be adjusted.

12. A roller screen according to claim 4 for shielding adjacent openings in an inclined roof surface and a subjacent dwarf wall, comprising two screen webs with individual roller bars positioned at the upper edge of the opening in the roof surface and at the lower edge of the opening in the dwarf wall, respectively, said webs having individual bottom bars, guide rails pertaining to each of said webs being mounted at the lateral edges of both openings so that the guide rails pertaining to the opening in the roof surface and the opening in the dwarf wall, respectively, extend in common planes and form an angle with each other corresponding to the inclination of the roof surface, stop members being mounted at the adjacent ends of the guide rails for the openings in the roof surface and the dwarf wall, respectively, each of said stop members including said track and said recess, said stop members being interconnected by a hinge joint allowing the angle between said stop members to be adjusted.

* * * * *